US005295759A

United States Patent [19]

Flanders et al.

[11] Patent Number: 5,295,759

[45] Date of Patent: Mar. 22, 1994

[54] SNOW PLOW COMPATIBLE SPEED BUMPS

[75] Inventors: Stephen N. Flanders, Norwich; Robert A. Eaton, East Thetford, both of Vt.

[73] Assignee: The United States of America as represented by the Secretary of the Army, Washington, D.C.

[21] Appl. No.: 45,350

[22] Filed: Apr. 13, 1993

[51] Int. Cl.[5] ..... E01F 13/00; E01F 9/06

[52] U.S. Cl. ..... 404/15; 14/69.5

[58] Field of Search ..... 404/15, 16; 14/69.5

[56] References Cited

U.S. PATENT DOCUMENTS

| | | | |
|---|---|---|---|
| 3,975,108 | 8/1976 | Suhr et al. | 404/16 |
| 4,687,370 | 8/1987 | Knowles | 404/15 |
| 4,697,294 | 10/1987 | Schäfer | 404/16 X |
| 5,106,226 | 4/1992 | Fanslow et al. | 404/15 |

FOREIGN PATENT DOCUMENTS

| | | | |
|---|---|---|---|
| 2596081 | 9/1987 | France | 404/16 |
| 2030197 | 4/1980 | United Kingdom | 404/15 |
| 2079356 | 1/1982 | United Kingdom | 404/15 |
| 2104946 | 3/1983 | United Kingdom | 404/16 |

*Primary Examiner*—Ramon S. Britts
*Assistant Examiner*—James A. Lisehora
*Attorney, Agent, or Firm*—Luther A. Marsh

[57] ABSTRACT

A speed bump for use in connection with highways located in climates where a snow plow is used to clear the highways includes a raised mass fabricated from highway construction material. The raised mass has a crown, a base where the raised mass meets a surface of the highway, and a slope of the raised mass between the crown and the base. The slope presents a profile in the area of the slope at which a snow plow is likely to encounter the speed bump such that the snow plow is lifted smoothly over the speed bump.

3 Claims, 2 Drawing Sheets

SNOW PLOW COMPATIBLE SPEED BUMPS

The present invention pertains to speed bumps of the type used to control the speed of vehicular traffic on roads and, more particularly, to such speed bumps which are compatible with the use of snow plows.

BACKGROUND OF THE INVENTION

Speed bumps are an effective means of preventing excessive speeds on roads. The typical speed bump consists of a ridge extending transversely to the direction of traffic flow across one or more lanes of the roadway. These speed bumps are normally formed of paving material, such as asphalt or concrete, and have a cross-sectional configuration approximating that of a segment of a circle with a sharp angle of intersection with the pavement surface. This sharp angle presents an obstacle for snow plows requiring careful operation on the part of the plow operator to avoid damage to the speed bumps and to the snow plow equipment. One approach to this problem has been the use of removable speed bumps. This, however, requires manual removal and installation, according to the season, and the desired traffic control is, obviously, lacking during the winter season. A second approach is the use of speed dips rather than speed bumps. Speed dips involve cutting into the existing pavement surface which may contribute to the deterioration thereof.

It is the primary object of the present invention to provide a speed bump which is compatible with the use of snow plows on the road surface while maintaining the traffic control aspects of the bump.

It is also an object of the present invention to provide such speed bumps which are permanent road features.

A further object of the present invention is the provision of permanent, snow plow compatible speed bumps which are formed of conventional road construction materials.

SUMMARY OF THE INVENTION

The above and other objects of the present invention which will become apparent hereinafter are achieved by the provision of speed bumps which include ramp portions providing a smooth transition from the pavement surface to lift a plow without jarring the plow or permitting unacceptable wear or damage to the speed bump. The ramp or ramps may be located so as to be engaged by the plow blade but laterally offset from the path of vehicle wheels thus maintaining the effectiveness of the speed bumps. In an alternative construction, a dip is provided in the middle of the bump for the same purpose.

For a more complete understanding of the invention and the objects and advantages thereof, reference should be had to the accompanying drawings and the following detailed description wherein preferred embodiments of the invention are illustrated and described.

DESCRIPTION OF THE PREFERRED EMBODIMENTS

Figure 1:
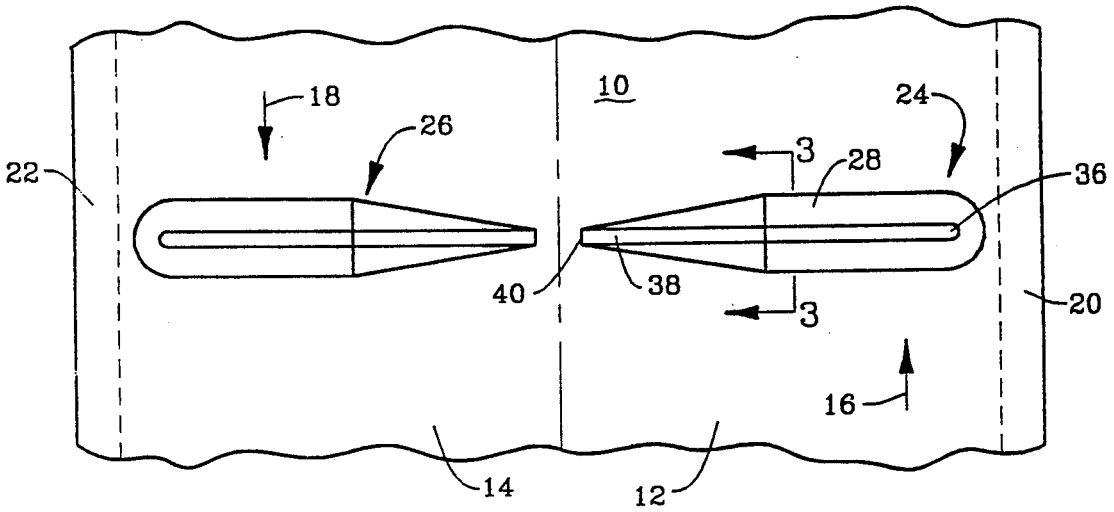
FIG. 1 is a plan view of a first embodiment of the snow plow compatible speed bump of the present invention.
Figure 2:
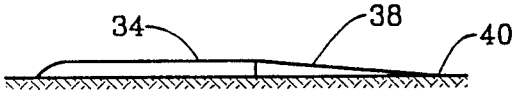
FIG. 2 is a side elevational view of one of the speed bumps of FIG. 1.
Figure 3:
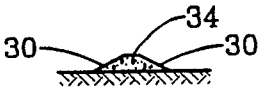
FIG. 3 is a transverse cross sectional view taken on the line 3—3 of FIG. 1.

Having reference to FIGS. 1 through 3, there is shown a roadway 10 having two traffic lanes 12 and 14 for vehicular movement in the directions of the arrows 16 and 18 and side bicycle lanes 20 and 22. The traffic lanes 12 and 14 are provided with speed bumps 24 and 26, respectively, the two speed bumps being of identical construction and are made of suitable road construction material, such as asphalt. Each of the speed bumps 24 and 26 is a raised mass of the material and consists of a first portion 28 of cross sectional configuration which is that of a conventional speed bump, having a base meeting the surface of the highway, sloping sides 30 and a crown 34 selected so as to provide effective speed control of vehicles using the road and terminating in a rounded end 36. By way of example, the height of the bump may be 4", the width of each side being 8" and the width of the crown being 4". The portion 28 is located on the pavement so as to extend across the path of travel of the right wheels of the vehicle. The speed bump of this embodiment also includes a second portion 38 which slopes downwardly from the first portion 28 to form a smooth juncture at its end 40 with the pavement surface. This second portion 38 functions as a ramp to smoothly lift the leading edge of the snow plow blade over the speed bump, it will be appreciated that snow plow blades are angled relative to the line of travel on the roadway so as to direct snow toward the side of the road.

Suitable materials include, but are not limited to, asphalt concrete, portland cement concrete, high-density elastomeric plastic such as neoprene or polyurethane, or metal such as aluminum or corrosion-resistant steel.

Figure 4:
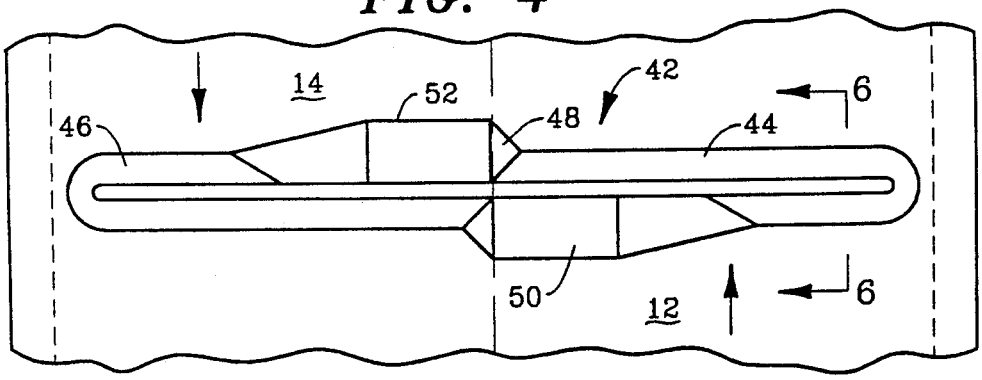
FIG. 4 is a plan view of a second embodiment of the snow plow compatible speed bump of the present invention.
Figure 5:
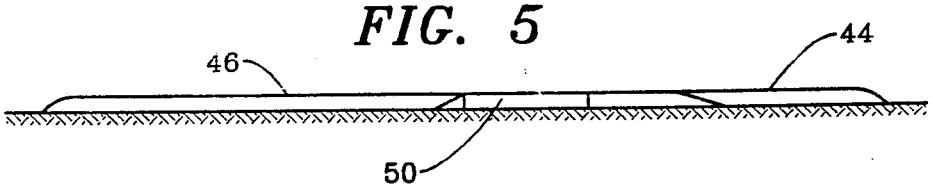
FIG. 5 is a side elevational view of the speed bump of FIG. 4.
Figure 6:
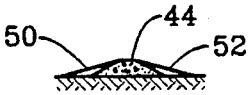
FIG. 6 is a transverse cross sectional view taken on the line 6—6 of FIG. 4.

The embodiment of the invention illustrated in FIGS. 4, 5 and 6 is a single speed bump 44 extending across both lanes of travel 12 and 14. This speed bump includes end portions 44 and 46 which are, again, of conventional speed bump configuration and a central portion the crown of which is continuous with that of the side portions and which includes ramp portions 50 and 52 located, respectively, at opposite sides of the centerline of the roadway, the ramp portions being of shallower angles than the sides of the end portions to engage and lift the leading edge of the snow plow. By way of example, the width of the ramps 50 and 52 may be twice that of the sides of the end portions of the speed bump.

Figure 7:
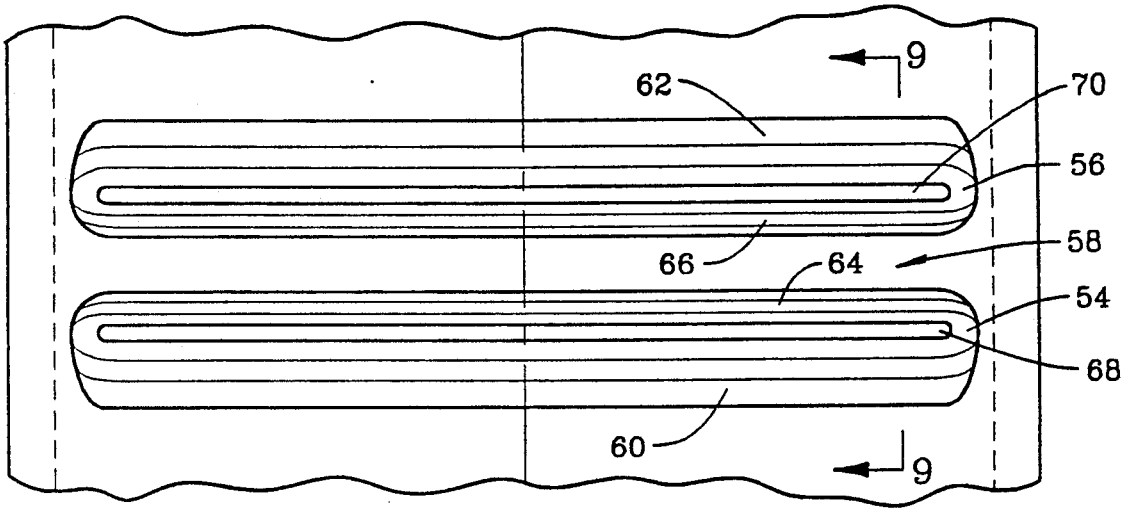
FIG. 7 is a plan view of a third embodiment of the snow plow compatible speed bump of the present invention.
Figure 8:
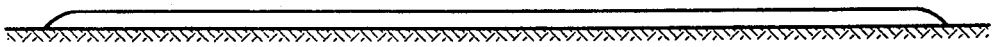
FIG. 8 is a side elevational view of the speed bump of FIG. 7.
Figure 9:
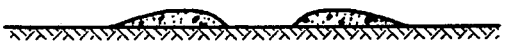
FIG. 9 is a transverse cross sectional view taken on the line 9—9 of FIG. 7.

A third embodiment of the snow plow compatible speed bump of the present invention is illustrated in FIGS. 7, 8 and 9. In this embodiment, two raised masses 54 and 56 are provided, extending across the traffic lanes of the roadway and separated by a gap 58. The sides 60 and 62 of each raised mass, which constitute the leading and trailing edges of the construction, slope upwardly at shallow angles to provide smooth transition for the plow blade, while the sides 64 and 66, which face one another, are relatively steep so that the, together with the gap 58, provide the desired speed control. By way of example, the width of the gap may be 8" the width of each of the sides 64 and 66 may be 8" and the width of the sides 60 and 62 may be 16" where the overall height of the construction is 4".

It will be appreciated that while preferred embodiment of the invention have been illustrated and described in detail herein, changes and additions may be had therein and thereto without departing from the spirit of the invention. Reference should, accordingly, be had to the appended claims in determining the true scope of the invention.

What is claimed is:

1. Speed bumps for use in connection with highways located in climates where a snow plow is used to clear the highways comprising:

speed bumps fabricated from highway construction material;

said speed bumps each having a length extending in an axial direction substantially across adjacent traffic lines of a road surface;

said speed bumps each having a flat crown of fixed width running substantially the length of each bump, wherein said bumps have adjacent ends with tapered portions which taper down toward the road surface both in the axial direction and in a direction perpendicular to the axial direction;

said flat crowns extending down said tapered portions to said adjacent ends of said bumps;

said tapered portions narrowing inward toward a central axis of the bumps such that the width of the adjacent ends of said bumps are equal to the fixed width of the flat crown; and wherein said tapered portions are structurally configured to allow a snow plow to lift smoothly over said speed bumps.

2. The speed bumps of claim 1 wherein the profile presented by said tapered portions comprise ramped surfaces.

3. The speed bumps of claim 1 wherein said construction material is selected from the group consisting of asphalt, portland cement concrete, high-density elastomeric plastic, and corrosion-resistant metal.

* * * * *

UNITED STATES PATENT AND TRADEMARK OFFICE

CERTIFICATE OF CORRECTION

PATENT NO. : 5,295,759

DATED : March 15, 1994

INVENTOR(S) : Stephen N. Flanders

It is certified that error appears in the above-identified patent and that said Letters Patent is hereby corrected as shown below:

On the title page, item [75] Inventor: "Robert A. Eaton" should be deleted.

Signed and Sealed this

Third Day of January, 1995

*Attest:*

*Attesting Officer*

BRUCE LEHMAN

*Commissioner of Patents and Trademarks*